US007946239B1

(12) United States Patent
Perry et al.

(10) Patent No.: US 7,946,239 B1
(45) Date of Patent: May 24, 2011

(54) CLEAT CLAMP SYSTEM

(76) Inventors: Heath A. Perry, Oldsmar, FL (US); Kathryn E. Perry, Oldsmar, FL (US); Rebecca J. Perry, Oldsmar, FL (US)

( * ) Notice: Subject to any disclaimer, the term of this patent is extended or adjusted under 35 U.S.C. 154(b) by 177 days.

(21) Appl. No.: 12/386,103

(22) Filed: Apr. 14, 2009

Related U.S. Application Data

(63) Continuation-in-part of application No. 12/011,179, filed on Jan. 24, 2008, now Pat. No. 7,870,829, and a continuation-in-part of application No. 12/077,572, filed on Mar. 20, 2008, now Pat. No. 7,603,960.

(51) Int. Cl.
*B63B 21/04* (2006.01)

(52) U.S. Cl. ..... 114/218

(58) Field of Classification Search ..... 114/218, 114/221 R, 364
See application file for complete search history.

(56) References Cited

U.S. PATENT DOCUMENTS 7,603,960 B1 * 10/2009 Perry et al. ..... 114/364
2004/0101351 A1 * 5/2004 Pitcher ..... 403/109.5
* cited by examiner

*Primary Examiner* — Stephen Avila

(57) ABSTRACT

A coupling assembly includes a fixed component and a pivotable component. The fixed component has a base and an upstanding projection with a central bore and a plurality of small apertures around the bore. The pivotable component has a distal section and a proximal section with a planar face in sliding contact with the fixed component. The pivotable component has a threaded aperture axially aligned with the bore of the fixed component. A pin in the planar face is selectively positionable in a small aperture. Intermediate components adjustably couple the fixed and pivotable components. The intermediate components include a bolt received in the threaded aperture and slidably received in the bore. The bolt has a free end extending through the bore with a nut adjacent to the free end. A coil spring on the bolt between the nut and the fixed component urges the pin into a small aperture.

6 Claims, 7 Drawing Sheets

FIG 8
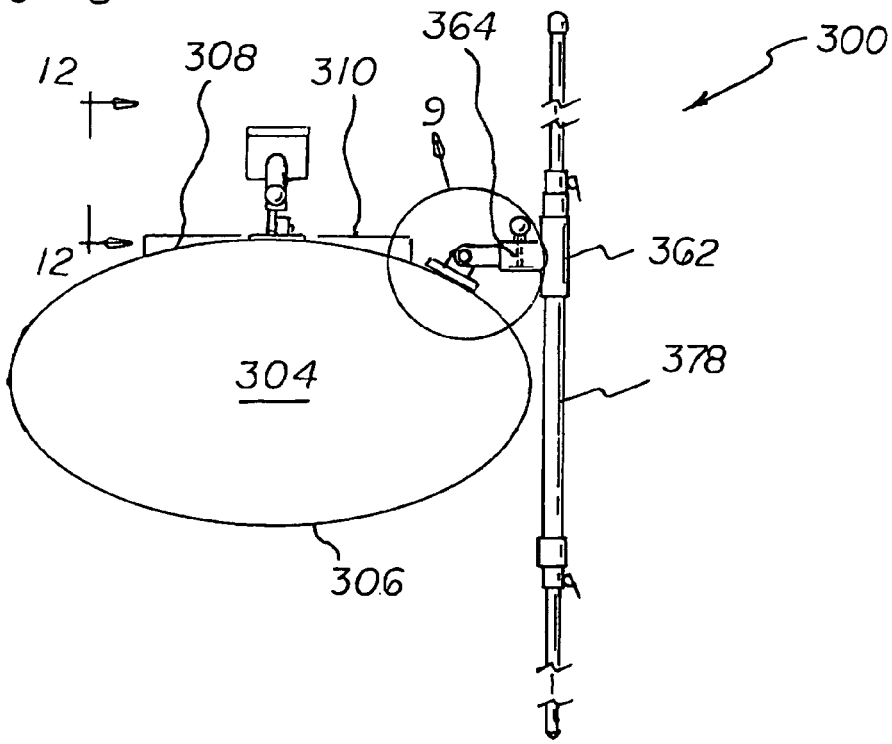
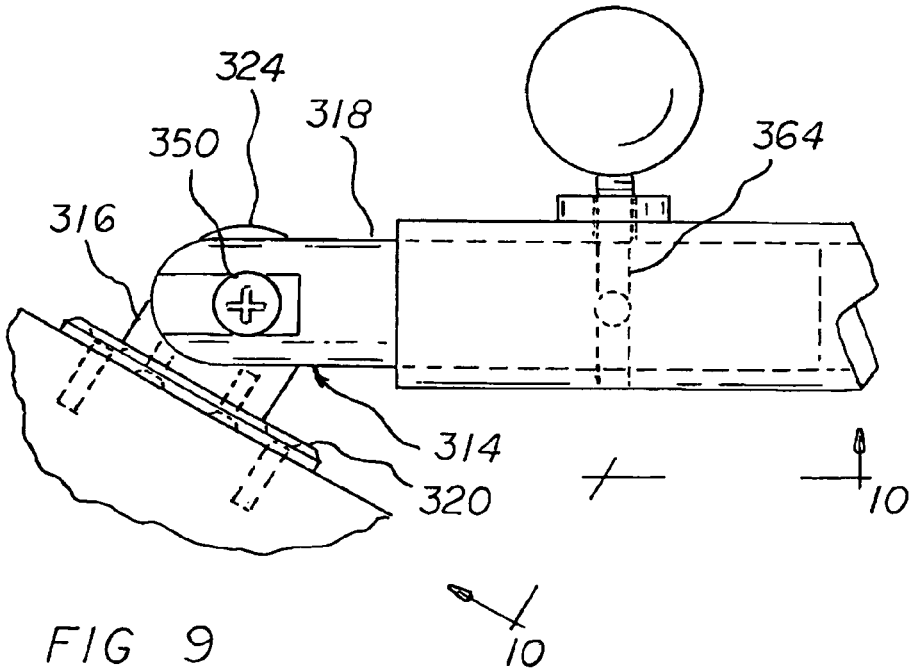
FIG 9

FIG 12
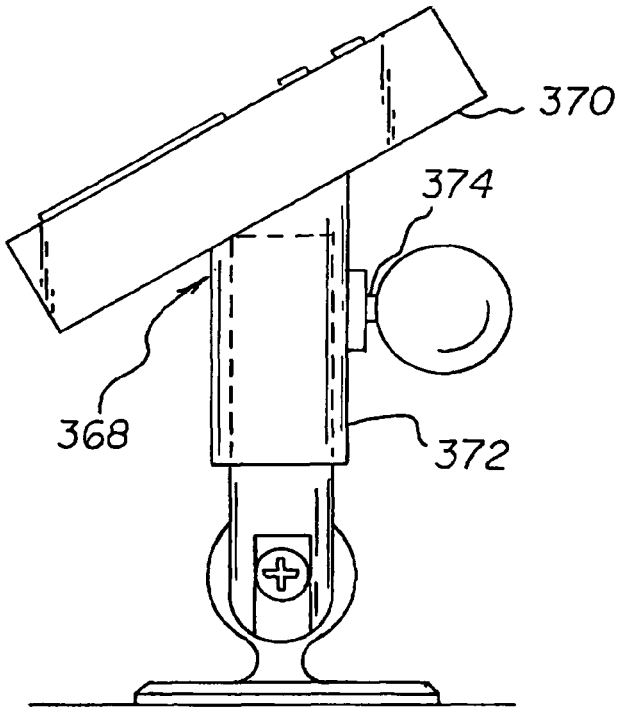
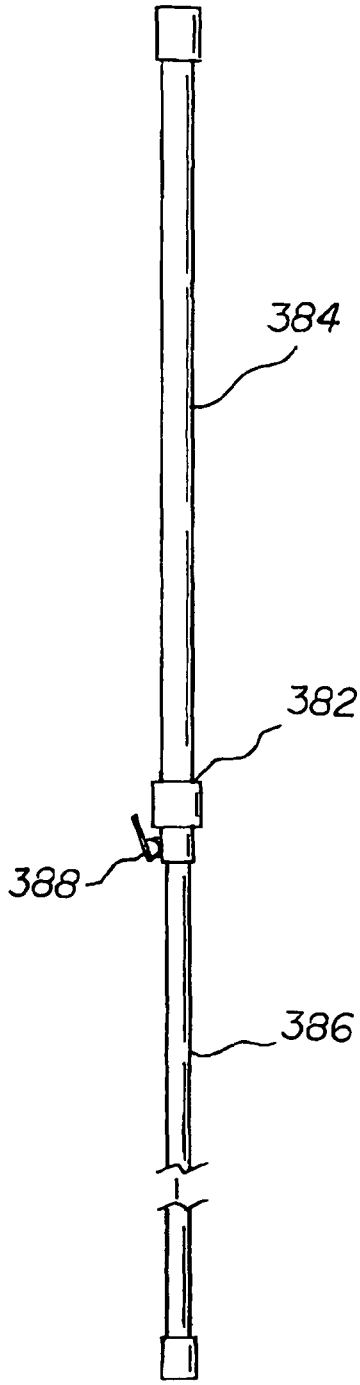
FIG 13

CLEAT CLAMP SYSTEM

RELATED APPLICATIONS

This application is a continuation-in-part of U.S. application Ser. No. 12/011,179 filed Jan. 24, 2008 now U.S. Pat. No. 7,870,829 issued Jan. 18, 2011 and Ser. No. 12/077,572 filed Mar. 20, 2008 now U.S. Pat. No. 7,603,960 issued Sep. 30, 2009, the subject matter of which applications is incorporated herein by reference.

BACKGROUND OF THE INVENTION

Field of the Invention

The present invention relates to a cleat clamp system and more particularly pertains to removably coupling a wide variety of objects to a boat in a safe, reliable, convenient manner.

SUMMARY OF THE INVENTION

In view of the foregoing disadvantages inherent in the known types of coupling systems of known designs and configurations now present in the prior art, the present invention provides an improved cleat clamp system. As such, the general purpose of the present invention, which will be described subsequently in greater detail, is to provide a new and improved cleat clamp system and method which has all the advantages of the prior art and none of the disadvantages.

To attain this, the present invention essentially comprises a kayak coupling system for removably securing any of a plurality of attachments to a kayak. A kayak is provided. The kayak has a hull with a forward end forwardly and a rearward end rearwardly. The hull has an upper surface with an opening for an occupant.

In this final embodiment, a primary coupling assembly is provided. The primary coupling assembly includes a fixed component and a pivotable component. The fixed component has a rectangular base with four corner holes for attachment to the kayak laterally offset from the opening. The fixed component also has an upstanding projection with an interior face and an exterior face and with parallel side edges terminating above in a semicircular top. The fixed component has a central bore and twelve small apertures arranged in a symmetrical circle around the bore. The bore and small apertures extend through the fixed component from the interior face to the exterior face. The pivotable component has a distal section in a cylindrical configuration. The distal section has a central extent formed with radial holes. The pivotable component has a proximal section with a planar face in sliding contact with the interior face of the fixed component. The pivotable component has a threaded aperture axially aligned with the bore of the fixed component. The pivotable component has two pins on opposite sides of the threaded aperture selectively positionable in two diametrically opposed small apertures in the fixed component.

Further provided are intermediate components adjustably coupling the fixed and pivotable components. The intermediate components include a bolt threadedly received in the threaded aperture and slidably received in the bore. The bolt has a conical head countersunk in the proximal section. The bolt has a free end extending through the bore with a nut adjacent to the free end. A coil spring on the bolt between the nut and the fixed component urges the pins into the small apertures for securely locking the pivotable component with respect to the fixed member. The pivotable component is adapted to be pulled away from the fixed member to retract the pins from the small apertures for repositioning the pivotable component from the fixed component.

A T-shaped coupler is provided next. The T-shaped coupler has a vertical extent with a vertical opening and a horizontal extent with a horizontal opening receiving the distal section of the pivotal member. A vertical rod extending through the T-shaped coupler and the distal section of the pivotable component is provided for securement purposes.

Next provided is a secondary coupling assembly similar in construction to the primary coupling assembly. The side walls of the fixed component are in an hour glass configuration. The secondary coupling assembly is attached to the kayak forwardly of the opening. A tray is provided for supporting miscellaneous navigational aides including maps, a global positioning system, a fish finder, depth finder, camera, umbrella mount and the like. The tray has a downwardly extending sleeve positioned over the distal end of the pivotable component. A supplemental rod extending through the sleeve and one of the holes of the distal section of the pivotable component for securement purposes.

Next provided is a shallow water anchor. The shallow water anchor has a central extent adapted to be positioned in and pass through the vertical opening of the T-shaped coupler.

Lastly, a telescopic push pole is provided. The push pole has a central extent adapted to be positioned in and pass through the vertical opening of the T-shaped coupler. The push pole has an upper tube and a lower tube. The lower tube is of a size to be slidingly received within the upper tube when in a contracted inoperative orientation. The lower tube is adapted to extend from the upper tube when in a extended operative orientation. The upper tube has a lower end with a lever lock for retaining the lower tube in an intended orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cleat clamp system which has all of the advantages of the prior art coupling systems of known designs and configurations and none of the disadvantages.

It is another object of the present invention to provide a new and improved cleat clamp system which may be easily and efficiently manufactured and marketed.

It is further object of the present invention to provide a new and improved cleat clamp system which is of durable and reliable constructions.

An even further object of the present invention is to provide a new and improved cleat clamp system which is susceptible of a low cost of manufacture with regard to both materials and labor, and which accordingly is then susceptible of low prices of sale to the consuming public, thereby making such cleat clamp system economically available to the buying public.

Even still another object of the present invention is to provide a cleat clamp system for removably coupling a wide variety of objects to a boat in a safe, reliable, convenient manner.

Lastly, it is an object of the present invention to provide a new and improved cleat clamp system. A coupling assembly includes a fixed component and a pivotable component. The fixed component has a base and an upstanding projection with a central bore and a plurality of small apertures around the bore. The pivotable component has a distal section and a proximal section with a planar face in sliding contact with the fixed component. The pivotable component has a threaded aperture axially aligned with the bore of the fixed component. A pin in the planar face is selectively positionable in a small aperture. Intermediate components adjustably couple the fixed and pivotable components. The intermediate components include a bolt received in the threaded aperture and slidably received in the bore. The bolt has a free end extending through the bore with a nut adjacent to the free end. A coil spring on the bolt between the nut and the fixed component urges the pin into a small aperture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a front elevational view of a kayak coupling system constructed in accordance with the principles of the invention.

FIG. 9 is en enlarged showing of a portion of the system taken at Circle 9 of FIG. 8.

FIG. 12 is a cross sectional view taken along line 12-12 of FIG. 8.

FIG. 13 is a side elevational view of a push pole adapted to the supported by the coupling system of the present invention.

The same reference numerals refer to the same parts throughout the various Figures.

DESCRIPTION OF THE PREFERRED EMBODIMENT

Figure 2:
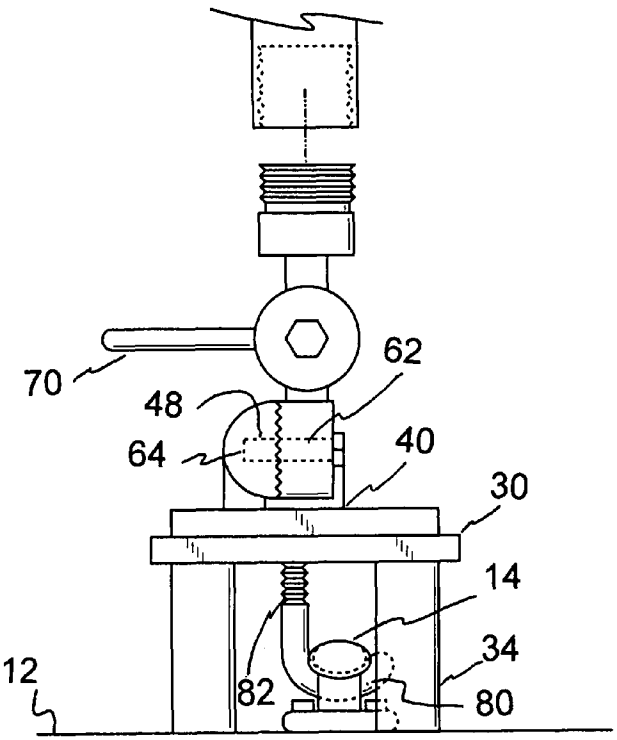
FIG. 2 is a front elevational view of the system shown in FIG. 1.
Figure 1:
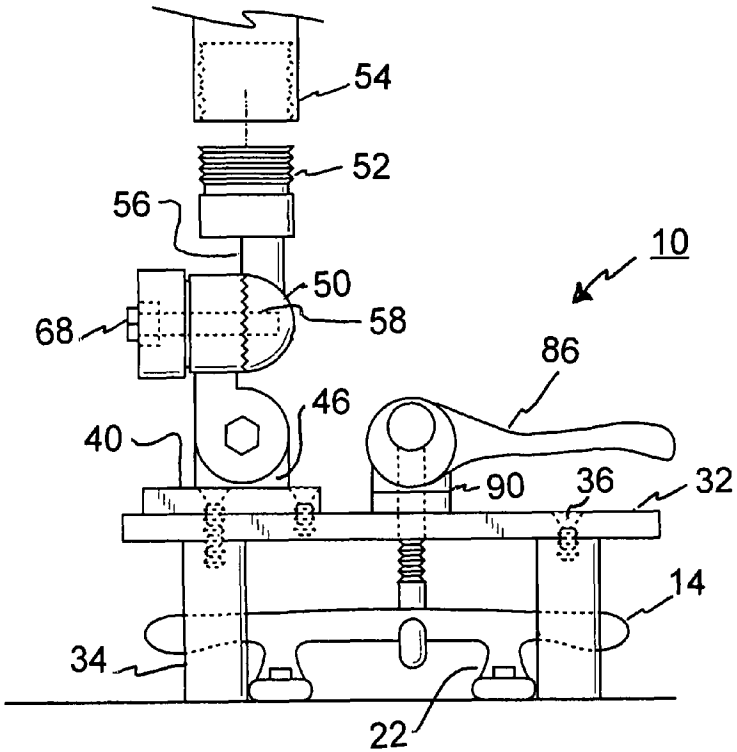
FIG. 1 is a side elevational view of a cleat clamp system constructed in acordance with the principles of the present invention.
Figure 3:
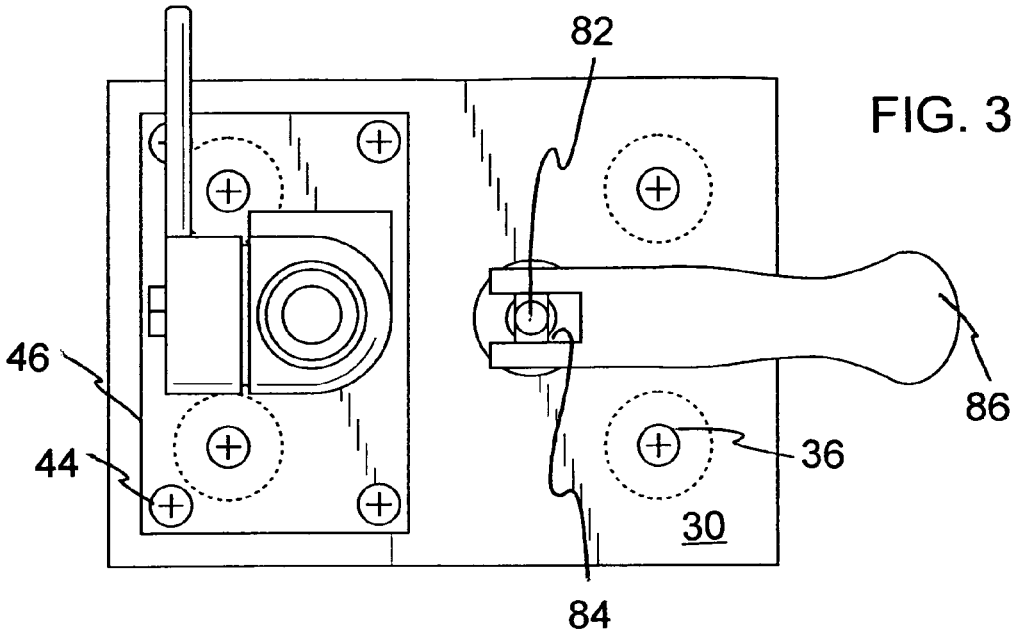
FIG. 3 is a plan view of the system shown in FIGS. 1 and 2.
Figure 4:
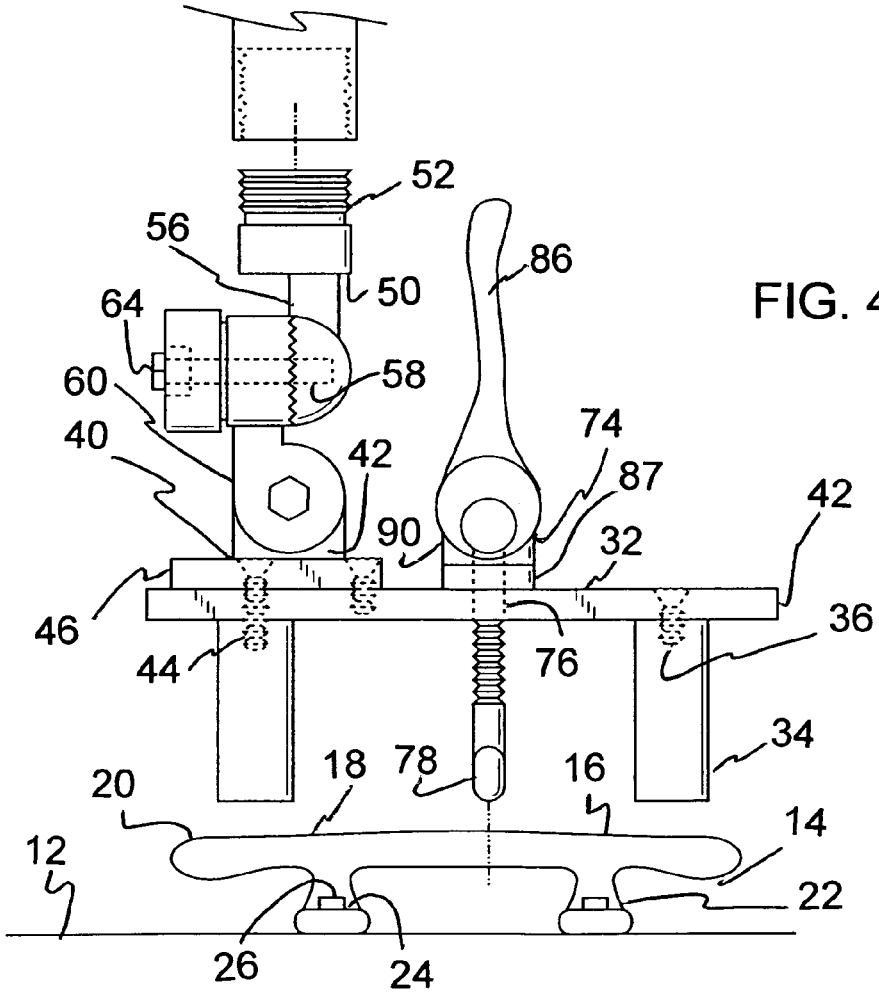
FIG. 4 is an exploded side elevational view similar to FIG. 1 but with the table, support hardware and coupling assembly separated from the cleat and the boat.

With reference now to the drawings, and in particular to FIG. 1 thereof, the preferred embodiment of the new and improved cleat clamp system embodying the principles and concepts of the present invention and generally designated by the reference numeral 10 will be described.

The present invention, the cleat clamp system 10 is comprised of a plurality of components. Such components in their broadest context include a table, support hardware and a locking assembly. Such components are individually configured and correlated with respect to each other so as to attain the desired objective.

First provided is a ship. The ship has an upper support surface 12. The upper support surface is in a horizontal plane. Attached to the support surface is a cleat 14. The cleat has a cross bar 16. The cross bar has a central section 18. The cross bar has end sections 20. The cross bar has laterally spaced support sections. The support sections are provided between the central and end sections. The cleat also has downwardly extending projections 22. The upper ends of the downwardly extending projections are formed integrally with the central sections. The lower ends of the downwardly extending projections are shaped to include apertures 24. Screws 26 are provided. The screws attach the cleat to the upper surface of the boat.

Provided next is a table 30. The table has a planar top panel 32. The table has an upper surface. The table has a lower surface. The table is in a rectangular configuration. The table has four downwardly extending legs 34. Each leg has an upper end. Each leg has a table bolt 36. The table bolt attaches the leg to the lower surface of the top panel. Each leg is provided in proximity to one corner of the lower surface of the top panel. The table is positioned on the upper surface of the boat. The central section of the cross bar is located between the legs and the ends sections of the cross bar. The central section of the cross bar extends beyond the legs.

Provided next is support hardware 40. The support hardware is attached to the upper surface of the top panel. The support hardware includes a base plate 42. The base plate is provided adjacent to one end of the upper surface above two of the legs. The support hardware includes four plate bolts 44. The plate bolts attach the plate to the top panel. The support hardware further includes a lower plate 46. The lower plate extends upwardly from the base plate. A horizontal threaded lower aperture 48 is provided perpendicular to the cross bar.

The support hardware also includes a terminal component 50. The terminal component has a threaded upper end 52. A fishing pole 54 is provided. The threaded upper end provides for the removable receipt of the fishing pole 54. The terminal component has an upper plate 56. The upper plate extends downwardly from the threaded upper end. A horizontal threaded upper aperture 58 is provided perpendicular to the threaded lower aperture.

The support hardware also includes an intermediate element 60. The intermediate element has an unthreaded lower aperture 62. The lower aperture is axially aligned with the threaded lower aperture. Mating radial teeth radiate from the lower apertures. The intermediate element has a lower coupling bolt 64. The intermediate element has a hexagonal recess. The hexagonal recess couples and uncouples the lower plate and intermediate element with the tightening and loosening of the lower coupling bolt. The intermediate element also has an unthreaded upper aperture 66. The upper aperture is axially aligned with the threaded upper aperture. Mating radial teeth radiate from the upper apertures. The intermediate element also has an upper coupling bolt 68. The upper coupling bolt couples and uncouples the terminal component and intermediate element with the tightening and loosening of the upper coupling bolt. The upper coupling bolt has a collar with a handle 70. In this manner the turning of the upper bolt is facilitated.

Provided last is a locking assembly 74. The locking assembly attaches and releases the table with the support hardware to the cleat and boat. The locking assembly includes an unthreaded hole 76 through the top panel of the table. A J-shaped hook 78 is formed with a lower arcuate section 80 adapted to be releasably positioned beneath the central section of the cross bar of the cleat and an upper threaded section 82 extending upwardly through the hole. A nut 84 threadedly receives the threaded section of the hook. A lever 86 is next provided. The lever supports the nut and the nut constitutes a pivot point for the lever. The locking assembly also includes a horizontal base plate 87 with an unthreaded aperture 88 for the hook and side plates 90 pivotally supporting the nut. The lever is adapted to pivot the cam in a first direction to raise the nut and hook to a locking orientation with the hook in secure engagement with the cleat. The locking assembly is adapted to be rotated about the axis of the upper portion of the bolt to raise and lower the hook with respect to the cleat for coupling and uncoupling purposes. The lever is adapted to pivot the cam in a second direction to lower the nut and hook to an unlocking orientation with the hook spaced from the cleat for separation purposes.

Figure 5:
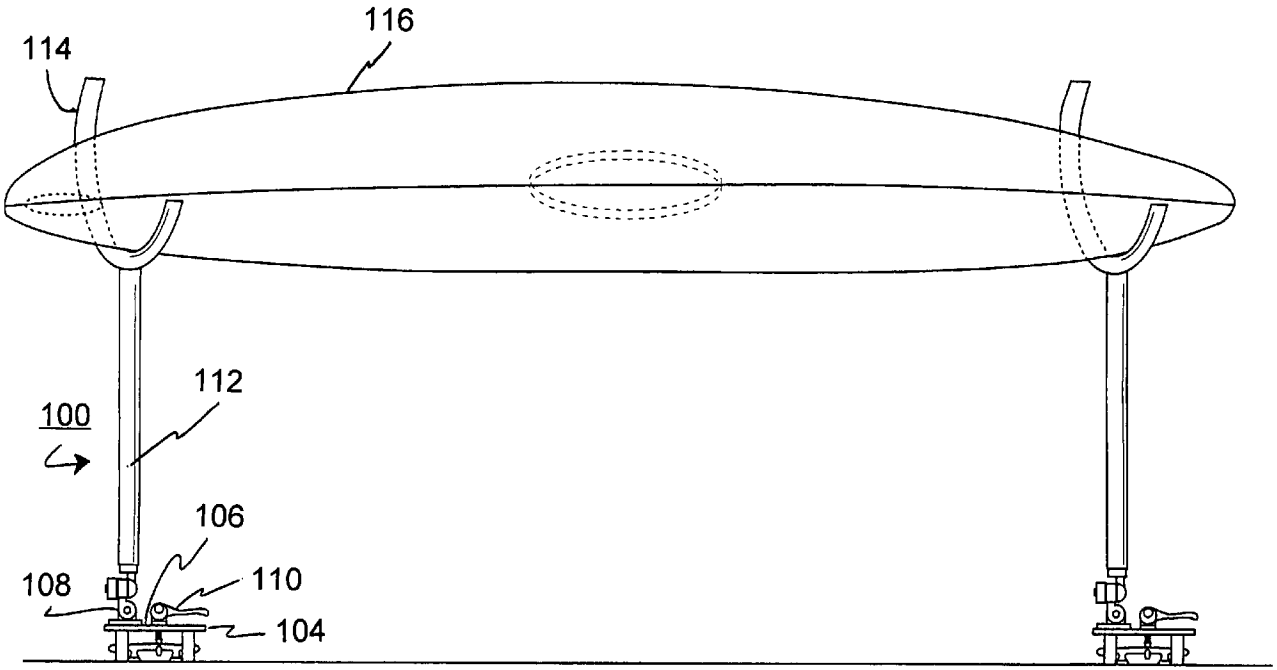
FIG. 5 is a side elevational view similar to FIG. 1 but illustrating an alternate embodiment of the invention.

Reference is now made to the alternate embodiment 100 of the invention as set forth in FIG. 5. A supplemental table 104 is provided. The supplemental table has a planar top panel 106. The supplemental table has downwardly extending legs. Each leg has an upper end. The upper end of each leg is attached to the top panel. Supplemental support hardware 108 is provided. The supplemental support hardware is attached to the upper surface of the top panel. A supplemental locking assembly 110 is also provided. The supplemental locking assembly attaches and releases the table with the support hardware to a cleat of a boat. The system further includes for each support hardware a vertical post 112. The vertical post has an arcuate upper end 114. A kayak 116 is provided. The upper ends of the vertical post are adapted to hold the kayak.

Figure 6:
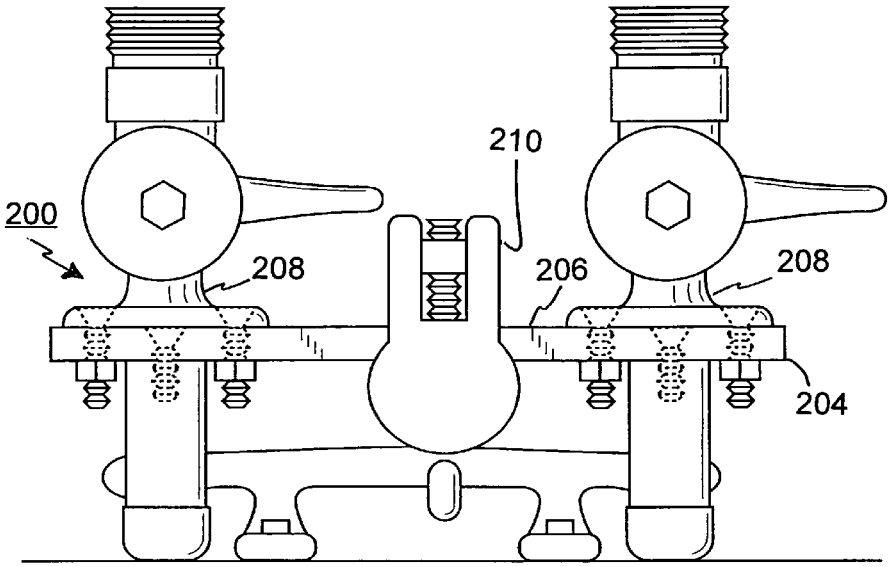
FIGS. 6 and 7 are side and end elevational views similar to FIGS. 1 and 2 but illustrating another alternate embodiment of the invention.
Figure 7:
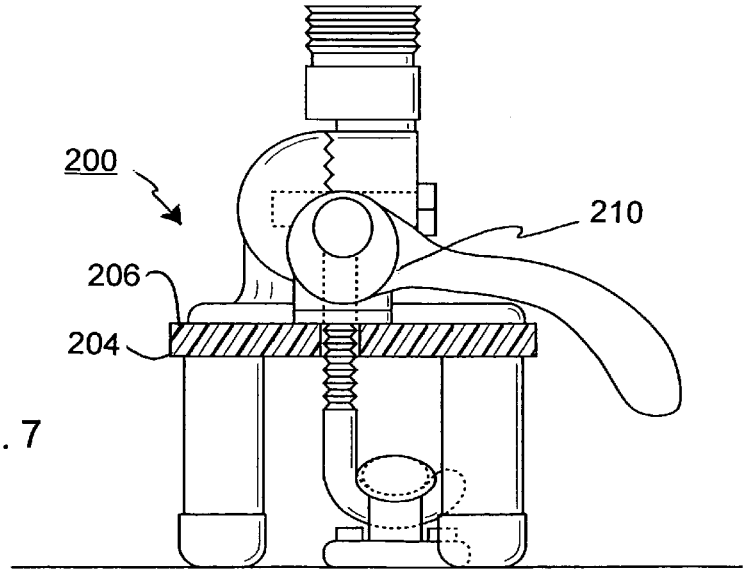
Figure 10:
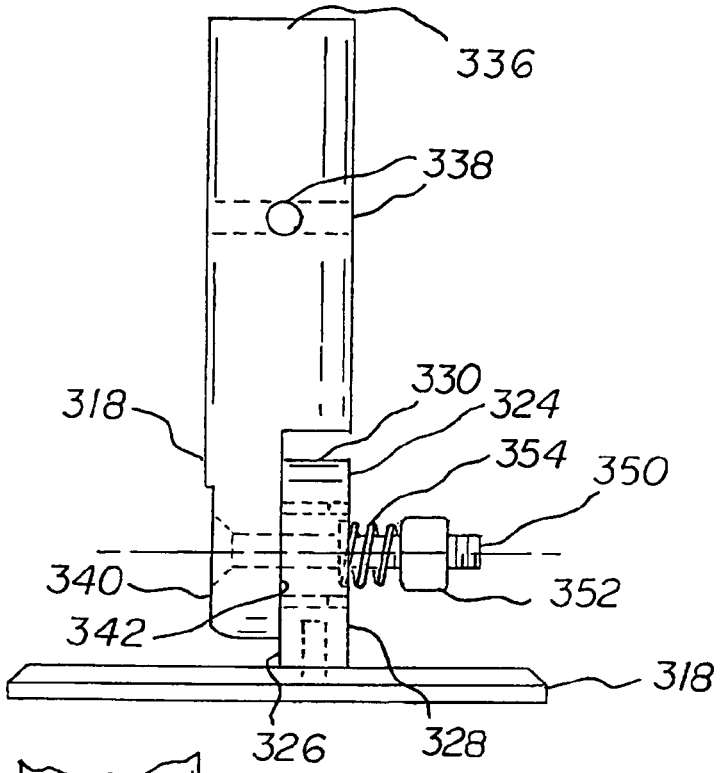
FIG. 10 is a side elevational view taken along line 10-10 of FIG. 9.
Figure 11:
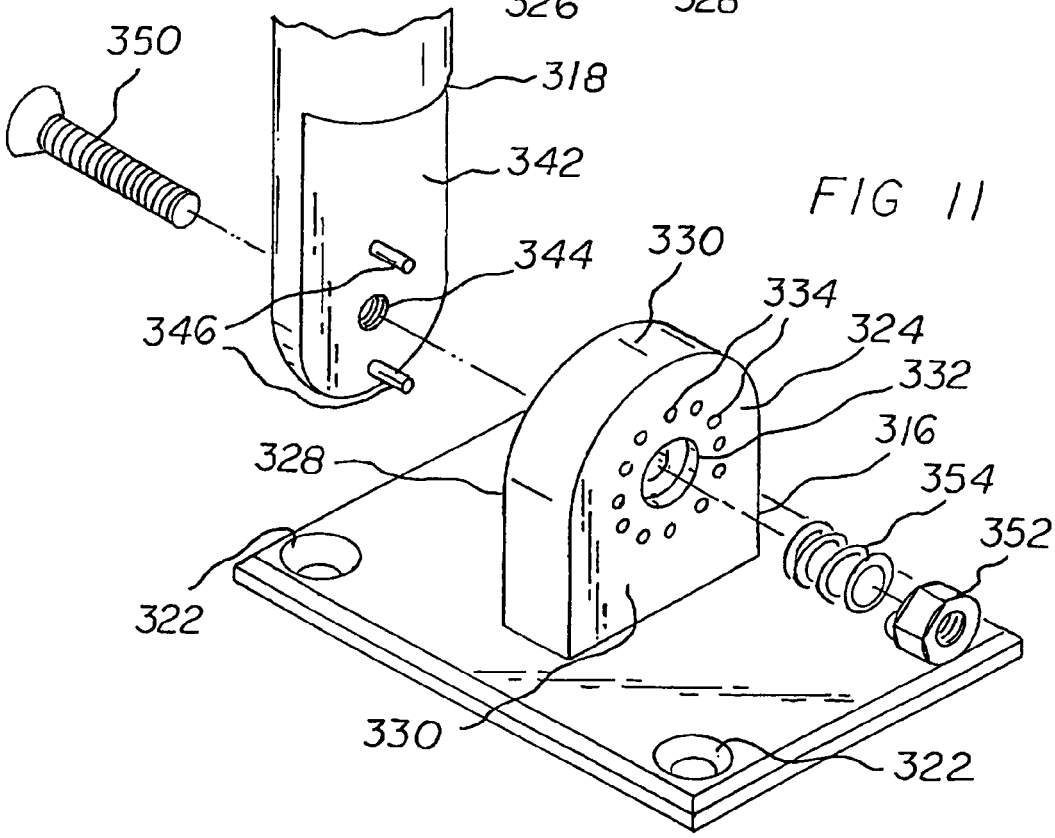
FIG. 11 is an exploded perspective illustration of the components of FIG. 10.

Reference is now made to the alternate embodiment 200 of the invention as set forth in FIGS. 6 and 7. A table 204 is provided. The table has an enlarged planar top panel 206. The table has downwardly extending legs. Each leg has an upper end. The upper end of each leg is attached to the top panel. Supplemental support hardware 208 is provided. The supplemental support hardware is attached to the upper surface of the top panel. A single locking assembly 210 is provided. The single locking assembly is provided between the support hardware. The locking assembly attaches and releases the table with the support hardware to a cleat of a boat.

In a final embodiment of the invention is a kayak coupling system 300 for removably securing any of a plurality of attachments to a kayak. In this embodiment, a kayak 304 has a hull 306 with a forward end forwardly and a rearward end rearwardly. The hull has an upper surface 308 with an opening 310 for an occupant.

In this final embodiment, a primary coupling assembly 314 is provided. The primary coupling assembly includes a fixed component 316 and a pivotable component 318. The fixed component has a rectangular base 320 with four corner holes 322 for attachment to the kayak laterally offset from the opening. The fixed component also has an upstanding projection 324 with an interior face 326 and an exterior face 328 and with parallel side edges terminating above in a semicircular top 330. The fixed component has a central bore 332 and twelve small apertures 334 arranged in a symmetrical circle around the bore. The bore and small apertures extend through the fixed component from the interior face to the exterior face. The pivotable component has a distal section 336 in a cylindrical configuration. The distal section has a central extent formed with radial holes 338. The pivotable component has a proximal section 340 with a planar face 342 in sliding contact with the interior face of the fixed component. The pivotable component has a threaded aperture 344 axially aligned with the bore of the fixed component. The pivotable component has two pins 346 on opposite sides of the threaded aperture selectively positionable in two diametrically opposed small apertures in the fixed component.

Further provided are intermediate components adjustably coupling the fixed and pivotable components. The intermediate components include a bolt 350 threadedly received in the threaded aperture and slidably received in the bore. The bolt has a conical head countersunk in the proximal section. The bolt has a free end extending through the bore with a nut 352 adjacent to the free end. A coil spring 354 on the bolt between the nut and the fixed component urges the pins into the small apertures for securely locking the pivotable component with respect to the fixed member. The pivotable component is adapted to be pulled away from the fixed member to retract the pins from the small apertures for repositioning the pivotable component from the fixed component.

A T-shaped coupler 362 is provided next. The T-shaped coupler has a vertical extent with a vertical opening and a horizontal extent with a horizontal opening receiving the distal section of the pivotal member. A vertical rod 364 extending through the T-shaped coupler and the distal section of the pivotable component is provided for securement purposes.

Next provided is a secondary coupling assembly 368 similar in construction to the primary coupling assembly. The side walls of the fixed component are in an hour glass configuration. The secondary coupling assembly is attached to the kayak forwardly of the opening. A tray 370 is provided for supporting miscellaneous navigational aides including maps, a global positioning system, a fish finder, depth finder, camera, umbrella mount and the like. The tray has a downwardly extending sleeve 372 positioned over the distal end of the pivotable component. A supplemental rod 374 extending through the sleeve and one of the holes of the distal section of the pivotable component for securement purposes.

Next provided is a shallow water anchor 378. The shallow water anchor has a central extent adapted to be positioned in and pass through the vertical opening of the T-shaped coupler.

Lastly, a telescopic push pole 382 is provided. The push pole has a central extent adapted to be positioned in and pass through the vertical opening of the T-shaped coupler. The push pole has an upper tube 384 and a lower tube 386. The lower tube is of a size to be slidingly received within the upper tube when in a contracted inoperative orientation. The lower tube is adapted to extend from the upper tube when in a extended operative orientation. The upper tube has a lower end with a lever lock 388 for retaining the lower tube in an intended orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A coupling system comprising:

a coupling assembly including a fixed component and a pivotable component, the fixed component having a base and an upstanding projection with a central bore and a plurality of small apertures around the bore, the pivotable component having a distal section and a proximal section with a planar face in sliding contact with the fixed component, the pivotable component having a threaded aperture axially aligned with the bore of the fixed component, a pin in the planar face selectively positionable in a small aperture; and intermediate components adjustably coupling the fixed and pivotable components, the intermediate components including a bolt received in the threaded aperture and slidably received in the bore, the bolt having a free end extending through the bore with a nut adjacent to the free end, a coil spring on the bolt between the nut and the fixed component urging the pins into a small aperture.

2. The system as set forth in claim 1 and further including:

a T-shaped coupler with a vertical extent with a vertical opening and a horizontal extent with a horizontal opening receiving the distal section of the pivotal member, a vertical rod extending through the T-shaped coupler and the distal end of the pivotable component for securement purposes.

3. The system as set forth in claim 2 and further including:

a shallow water anchor having a central extent adapted to be positioned in and passing through the vertical opening of the T-shaped coupler.

4. The system as set forth in claim 1 and further including:

a secondary coupling assembly similar in construction to the coupling assembly, the side walls of the fixed component being in an hour glass configuration, the secondary coupling assembly being attached to a kayak forwardly of an opening in the kayak, a tray for supporting miscellaneous navigational aides including maps, a global positioning system, a fish finder, depth finder, camera, umbrella mount and the like, the tray having a downwardly extending sleeve positioned over the distal end of the pivotable component, a supplemental rod extending through the sleeve and the distal section of the pivotable component for securement purposes.

5. The system as set forth in claim 2 and further including:

a telescopic push pole having a central extent adapted to be positioned in and passing through the vertical opening of the T-shaped coupler.

6. A kayak coupling system for removably securing any of a plurality of attachments to a kayak, the system comprising, in combination:

a kayak having a hull with a forward end forwardly and a rearward end rearwardly, the hull having an upper surface with an opening for an occupant;

a primary coupling assembly, the primary coupling assembly including a fixed component and a pivotable component, the fixed component having a rectangular base with four corner holes for attachment to the kayak laterally offset from the opening, the fixed component also having an upstanding projection with an interior face and an exterior face and with parallel side edges terminating above in a semicircular top, the fixed component having a central bore and twelve small apertures arranged in a symmetrical circle around the bore, the bore and small apertures extending through the fixed component from interior to exterior face, the pivotable component having a distal section in a cylindrical configuration, the distal section having a central extent formed with radial holes, the pivotable component having a proximal section with a planar face in sliding contact with the interior face of the fixed component, the pivotable component having a threaded aperture axially aligned with the bore of the fixed component, the pivotable component having two pins on opposite sides of the threaded aperture and selectively positionable in two diametrically opposed small apertures in the fixed component;

intermediate components adjustably coupling the fixed and pivotable components, the intermediate components including a bolt threadedly received in the threaded aperture and slidably received in the bore, the bolt having a conical head countersunk in the proximal section, the bolt having a free end extending through the bore with a nut adjacent to the free end, a coil spring on the bolt between the nut and the fixed component urging the pins into the small apertures for securely locking the pivotable component with respect to the fixed member, the pivotable component adapted to be pulled away from the fixed member to retract the pins from the small apertures for repositioning the pivotable component from the fixed component;

a T-shaped coupler with a vertical extent with a vertical opening and a horizontal extent with a horizontal opening receiving the distal section of the pivotal member, a vertical rod extending through the T-shaped coupler and the distal section of the pivotable component for securement purposes;

a secondary coupling assembly similar in construction to the primary coupling assembly, the side walls of the fixed component being in an hour glass configuration, the secondary coupling assembly being attached to the kayak forwardly of the opening, a tray for supporting miscellaneous navigational aides including maps, a global positioning system, a fish finder, depth finder, camera, umbrella mount and the like, the tray having a downwardly extending sleeve positioned over the distal end of the pivotable component, a supplemental rod extending through the sleeve and one of the holes of the distal section of the pivotable component for securement purposes;

a shallow water anchor having a central extent adapted to be positioned in and passing through the vertical opening of the T-shaped coupler; and a telescopic push pole having a central extent adapted to be positioned in and passing through the vertical opening of the T-shaped coupler, the push pole having an upper tube and a lower tube, the lower tube being of a size to be slidingly received within the upper tube when in a contracted inoperative orientation, the lower tube adapted to extend from the upper tube when in a extended operative orientation, the upper tube having a lower and with a lever lock for retaining the lower tube in an intended orientation.

* * * * *